US010006247B2

(12) United States Patent
Ebner

(10) Patent No.: US 10,006,247 B2
(45) Date of Patent: Jun. 26, 2018

(54) ACCESS CONTROL DEVICE FOR PERSONS OR DEVICE FOR COUNTING PERSONS DESIGNED AS A TURNSTILE

(71) Applicant: SKIDATA AG, Grödig (AT)

(72) Inventor: Johann Ebner, Salzburg (AT)

(73) Assignee: Skidata AG, Grödig/Salzburg (AT)

( * ) Notice: Subject to any disclaimer, the term of this patent is extended or adjusted under 35 U.S.C. 154(b) by 0 days. days.

(21) Appl. No.: 15/486,687

(22) Filed: Apr. 13, 2017

(65) Prior Publication Data

US 2017/0306698 A1 Oct. 26, 2017

(30) Foreign Application Priority Data

Apr. 26, 2016 (EP) ..... 16167003

(51) Int. Cl.
*E06B 11/08* (2006.01)
*E05F 15/60* (2015.01)

(52) U.S. Cl.
CPC ..... *E06B 11/08* (2013.01); *E05F 15/60* (2015.01); *E05Y 2900/40* (2013.01)

(58) Field of Classification Search
CPC ..... E06B 11/08; E05F 15/60
USPC ..... 49/46, 47
See application file for complete search history.

(56) References Cited

U.S. PATENT DOCUMENTS 1,215,906 A 2/1917 Campbell
1,617,918 A * 2/1927 McLoughlin ..... E06B 11/08 194/255
3,998,008 A * 12/1976 Collins ..... G07F 17/14 49/47
5,056,261 A * 10/1991 Tetherton ..... E06B 11/08 49/35
6,012,252 A * 1/2000 Kocznar ..... E06B 11/08 49/42
6,044,586 A * 4/2000 Wotke ..... E06B 11/08 49/47
6,715,234 B1 * 4/2004 Libardi ..... E06B 11/08 49/42
7,360,695 B2 * 4/2008 Ponert ..... G07C 9/00111 235/382
7,627,984 B2 * 12/2009 Wallerstorfer ..... E06B 11/08 49/47
7,845,115 B2 * 12/2010 Ponert ..... G07C 9/025 49/26
8,171,671 B2 5/2012 Gallenschutz
9,243,449 B1 * 1/2016 Ziemkowski ..... E06B 11/085
(Continued)

FOREIGN PATENT DOCUMENTS

DE 102005028712 A1 12/2006
EP 2995762 A1 * 3/2016 ..... E05F 15/60

OTHER PUBLICATIONS

European Search Report issued in corresponding European Patent Application No. 16167003.9 dated Oct. 6, 2016.

*Primary Examiner* — Jerry E Redman
(74) *Attorney, Agent, or Firm* — Davis & Bujold PLLC; Michael J. Bujold

(57) ABSTRACT

An access control device for persons designed as a turnstile (1) or a device for counting persons designed as a turnstile (1) is proposed which comprises a housing (2) in which at least one drive is arranged and which comprises two barrier arms (3, 4) which can be driven by at least one drive, which can be driven and controlled independently of one another and at the same speed or at a different speed.

7 Claims, 8 Drawing Sheets

(56) References Cited

U.S. PATENT DOCUMENTS

| | | | | |
|---|---|---|---|---|
| 2006/0000144 | A1* | 1/2006 | Wallerstorfer | E06B 11/08 49/47 |
| 2007/0277439 | A1* | 12/2007 | Ponert | E06B 11/08 49/44 |
| 2009/0307976 | A1* | 12/2009 | Burgin | E06B 11/08 49/47 |
| 2009/0312873 | A1* | 12/2009 | Gallenschutz | E05D 3/04 700/275 |
| 2010/0162628 | A1* | 7/2010 | Gallenschuetz | E06B 11/08 49/46 |
| 2014/0096447 | A1* | 4/2014 | Harucksteiner | E06B 11/08 49/31 |
| 2014/0102003 | A1* | 4/2014 | Talpe | E06B 11/08 49/46 |
| 2016/0060944 | A1* | 3/2016 | Perkins | E06B 11/08 49/14 |

* cited by examiner

ACCESS CONTROL DEVICE FOR PERSONS OR DEVICE FOR COUNTING PERSONS DESIGNED AS A TURNSTILE

This application claims priority from European patent application serial no. 16167003.9 filed Apr. 26, 2016.

FIELD OF THE INVENTION

The present invention relates to an access control device for persons designed as a turnstile or a device for counting persons designed as a turnstile.

BACKGROUND OF THE INVENTION

Access control devices for persons and devices for counting persons designed as turnstiles are known from the prior art. They comprise one, two or three barrier arms which are connected in a torque-proof manner to a shaft which can be driven by an electric motor, wherein the angles between the longitudinal axes of the barrier arms are predefined by the torque-proof connection.

In the case of access control systems for persons designed as turnstiles, when a valid access authorization is read by means of a reading device, such a turnstile is transferred from a locking position into a release position by rotation of the shaft to which the barrier arms are connected in a torque-proof manner. In the case of devices for counting persons designed a turnstiles, when a person is detected in the passage, which can be accomplished by means of suitable sensors, for example, light sensors, light curtains, radar sensors etc. the shaft to which the barrier arms are connected in a torque-proof manner is transferred from a looking position into a release position. After each passage, the value of a counter assigned to the direction of passage is increased by 1.

In the case of turnstiles with three barrier arms, as a result of the fixed angle between the barrier arms the comfort during walking through is adversely affected since, for example, luggage or pushchairs must be raised above one of the three barrier arms. Since the angle between the longitudinal axes of two neighbouring barrier arms is usually 120°, in the addition the entire passage cannot be released since one barrier arm always projects into the passage. However, turnstiles with three barrier arms have the advantage that they ensure a sufficient channelling and separation effect since one person is always located between two barrier arms when passing through.

Furthermore, turnstiles with two barrier arms are known which are connected in a torque-proof manner to a shaft which can be driven by an electric motor, which however cannot eliminate the afore-mentioned disadvantages of turnstiles comprising three barrier arms. On the contrary, a secure separation is adversely affected. Furthermore, turnstiles with one barrier arm are known which however in order to ensure separation, are moved rapidly in order to release the passage on the one hand and ensure separation on the other hand, with the result that the risk of injury for persons passing through is increased. Furthermore the wear as a result of the high rotational speed of the mass of the single barrier arm is disadvantageously increased; the high rotational speed is caused by the fact that the barrier arm must be turned through 360 degrees per passage.

In addition, the turnstiles with two or three barrier arms known from the prior art have the disadvantage that in the case of an emergency or when the system is to be put out of operation, the entire passage cannot be released.

SUMMARY OF THE INVENTION

It is the object of the present invention to provide an access control device for persons designed as a turnstile or a device for counting persons designed as a turnstile which ensures a good separation with simultaneous release of the entire passage in the case of a valid access authorization.

Accordingly, an access control device for persons designed as a turnstile or device for counting persons designed as a turnstile is proposed, comprising a housing in which at least one drive means is arranged, which comprises two barrier arms which can be driven by at least one drive means, which can be driven and controlled independently of one another and with the same or different speed.

According to a further development of the invention, the barrier arms can be driven and controlled independently of one another in such a manner that a secure separation and in the presence of a valid access authorization, a release of the entire passage can be achieved.

The two barrier arms can preferably be driven and controlled independently of one another in such a manner that in the presence of a valid access authorization for the case of an access control device or in the event of detecting a person in the passage for the case of a device for counting persons, the barrier arm arranged in the direction of passage in an initial position in front of the person, which blocks the passage, completely releases the passage in front of the person wherein the second barrier arm which releases the passage in the initial position is controlled in such a manner that it blocks the passage in the direction of passage behind the person and the initial position is adopted again wherein in successive initial positions the position of the barrier arms is transposed.

In the case of an access control device for persons designed as a turnstile, the access authorizations according to the prior art are detected by a reading device of the access control device, wherein the validity is checked either locally or in a server connected to the access control device. The reading device can, for example, be an RFID reading device, a fingerprint scanner, an iris scanner, a barcode reader or a magnetic card reader. Furthermore, the reading device can be a reading device which can read out from a customer medium access authorizations or IDs which are assigned a valid access authorization by means of Bluetooth, Bluetooth Low Energy, WLAN or UWB standards. In addition, the turnstile can have a plurality of reading devices for different standards.

According to the invention, a first barrier arm is arranged on a first shaft and a second barrier arm is arranged on a second shaft, wherein the first shaft is designed as a hollow shaft through which the second shaft is guided. The first and second shaft are arranged coaxially to one another.

The barrier arms are connected in a torque-proof manner to the respective shaft at a predefined angle with respect to the shaft; for example, the barrier arms are placed or screwed on the respective shaft.

Preferably each shaft is assigned a drive means which for example can be designed as an electric motor which drives the shaft. Within the framework of further embodiments, the shafts can be driven hydraulically, pneumatically or electromagnetically. The drive means is preferably an electric motor with a transmission connected before the electric motor in the force flow direction, wherein the respective shaft can be driven by an output of the transmission. The transmission can, for example, be designed as a planetary gear, as a spur gear or as a belt drive or as a combination of the aforesaid types of transmission.

Within the framework of further embodiments, merely one drive means, e.g. an electric motor can be provided, before which a transmission with two outputs is connected, wherein one output each is connected to a shaft or can be connected detachably by means of a controllable coupling, wherein when the coupling is open the shafts can be rotated against a predefined resistance which is selected in such a manner that the respective barrier arm is held firmly without the action of external force and can be twisted with a defined torque. The transmissions are in this case designed in such a manner that a desired control of the barrier arms connected to the shaft is made possible, in particular a control which allows a secure separation and in the event of a valid access authorization, a release of the entire passage.

According to one embodiment of the invention, the first shaft designed as a hollow shaft has a recess at the end thereof facing away from the housing of the turnstile, from which the second barrier arm assigned to the second shaft projects, wherein the recess extends over a predefined angular range which for example can have values between 200° and 300° and wherein the first and second barrier arm project axially from the same axial position when viewed along the central longitudinal axes of the shafts arranged coaxially with respect to one another. Here the recess is arranged diametrically opposite the first barrier arm connected to the first shaft. In this way, both barrier arms can rotate along the same trajectory. In this case both barrier arms can be moved independently of one another with respect to one another about an angular range which substantially corresponds to the angular range of the recess of the hollow shaft.

According to a further embodiment of the invention, the second barrier arm connected in a torque-proof manner to the second shaft projects from the end of the first shaft designed as a hollow shaft, facing away from the housing of the turnstile so that an arbitrary relative movement of the two barrier arms relative to one another can be achieved. In this case, both barrier arms each rotate along different trajectories.

In the event of an emergency or if the turnstile is to be put out of operation permanently, both barrier arms can be controlled in such a manner that they extend in the smallest possible angle with respect to one another in the direction of the plane of the passage so that the passage is released. In the event that the first shaft designed as a hollow shaft has a recess at its end facing away from the housing of the turnstile, from which the second barrier arm assigned to the second shaft projects, the smallest possible angle between the barrier arms is about 360° minus the angular range of the recess. Accordingly, for example the smallest possible angle between the barrier arms is 80° for the case where the recess extends over an angular range of 280°. For the case where an arbitrary relative movement of the two barrier arms with respect to one another can be achieved, the barrier arms can be controlled in such a manner that they are arranged substantially parallel to one another.

According to a further development of the invention, the turnstile has a battery which supplies the drive means preferably designed as electric motors with power in the event of a power failure, wherein it is ensured that in an emergency or when the turnstile is to be put out of operation permanently, both barrier arms can be controlled in such a manner that they extend in the smallest possible angle with respect to one another in the direction of the plane of the passage so that the passage is released.

The concept according to the invention provides a turnstile which has the functionality of a conventional turnstile with three barrier arms with regard to the channelling and separation effect but without the disadvantages resulting from the presence of the three barrier arms with regard to comfort. In addition, it is ensured that in an emergency the entire passage is released.

BRIEF DESCRIPTION OF THE DRAWINGS

The invention is explained in detail hereinafter with reference to the appended figures as an example which show an access control device for persons designed as a turnstile. Examples of possible controls of the barrier arms during access control are shown here; the control of the barrier arms of the turnstile according to the invention can be varied according to the requirements. The examples shown also apply similarly for a device for counting persons designed as a turnstile when detecting a person in the passage. In the appended figures, the top left part is a front view, the top right part is a plan view, the bottom left part is a side view and the bottom right part is a view of a turnstile according to the invention along the longitudinal axis of the first and second shaft. The direction of passage is shown from left to right in relation to the top left part of the figures. In the figures:

FIG. 4: shows a turnstile according to FIG. 1 in which after the further turning of only the second barrier arm through 90° shown in FIG. 3, the first and second barrier arm are turned independently of one another, wherein at the end of these turning movements the second barrier arm extends substantially perpendicular to the plane of the passage and the first barrier arm begins to block the passage behind the person who has passed through;

FIG. 10: shows a turnstile according to FIG. 7 in which after the further rotation only or the second barrier arm through 90° shown in FIG. 9, the first and the second barrier arm are turned independently of one another wherein at the end of these rotational movements the second barrier arm extends substantially perpendicular to the plane of the passage and the first barrier arm begins to block the passage behind the person who has passed through;

DETAILED DESCRIPTION OF THE PREFERRED EMBODIMENTS

Figure 1:
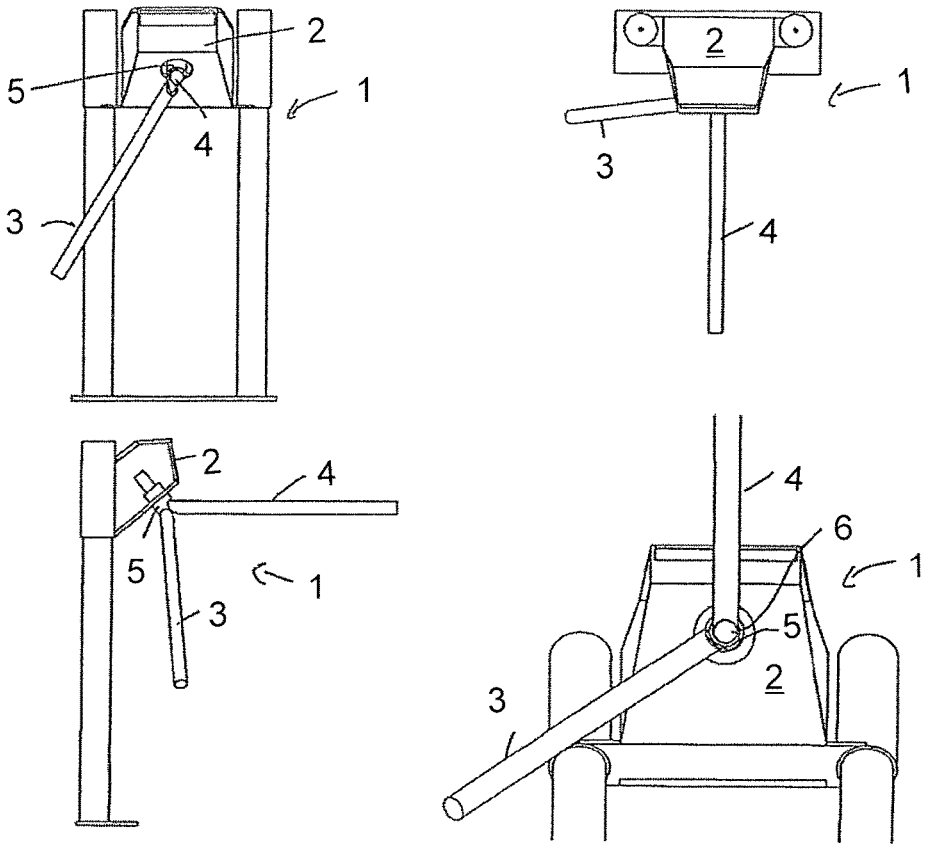
FIG. 1: shows a turnstile according to the invention in which the first shaft designed as a hollow shaft has a recess over an angular range of 240° at the end facing away from the housing of the turnstile, from which the second barrier arm assigned to the second shaft projects, in an initial position in which the second barrier arm blocks the passage wherein the first barrier arm substantially releases the entire passage with the result that a person can comfortably approach the second barrier arm and wherein the angle between the first and the second barrier arm is about 120°.

In the appended figures a turnstile is designated by 1, wherein a housing of the turnstile 1 is designed by 2, a first barrier arm by 3 and a second barrier arm by 4. Furthermore 5 designates the drivable shaft to which the first barrier arm 3 is connected in a torque-proof manner, wherein 6 designates the drivable shaft to which the second barrier arm 3 is connected in a torque-proof manner.

According to the invention, a turnstile 1 according to the invention comprises a housing 2 in which drive means are arranged. Furthermore the turnstile 1 comprises two barrier arms 3, 4 which can be driven by the drive means, which can be driven and controlled independently of one another and with the same or different speed in such a manner that a secure separation and in the case of a valid access authorization, a release of the entire passage can be achieved.

Here a first barrier arm 3 is arranged on a first shaft 5 and a second barrier arm 4 is arranged on a second shaft 6, wherein the first shaft 5 is designed as a hollow shaft through which the second shaft 6 is guided, wherein the first and second shaft 5, 6 are arranged coaxially to one another and wherein the barrier arms 3, 4 are connected to the respective shaft 5, 6 in a torque-proof manner at a predefined angle with respect to the shaft. Each shaft 5, 6 is assigned a drive means which can be controlled by a controller, which drives the shaft 5, 6. Preferably the shafts 5, 6 are each driven by an electric motor.

In the example shown in FIGS. 1 to 6, the first shaft 5 designed as a hollow shaft has a recess at the end facing away from the housing 2 of the turnstile 1 which is arranged diametrically opposite the first barrier arm 3 connected to the first shaft 5 from which the second barrier arm 4 assigned to the second, shaft 6 projects. In the example shown, the recess extends over 240°; according to the invention the first and second barrier arm project axially from the same axial position when viewed along the central longitudinal axes of the shafts 5, 6 arranged coaxially with respect to one another.

In the initial position which is illustrated by reference to FIG. 1, the passage is blocked by the second barrier arm 4 wherein the first barrier arm 3 releases the passage and projects slightly into the passage to make it difficult to climb underneath with the result that a person can comfortably approach the second barrier arm 4 and wherein the angle between the first and the second barrier arm is approximately 120°. According to the invention, in the initial position the barrier arm which does not block the passage, i.e. in the example shown in FIG. 1 the first barrier arm 3, can completely release the passage; the corresponding position of the barrier arm corresponds, for example, to the position of the first barrier arm 3 in FIG. 6.

Figure 2:
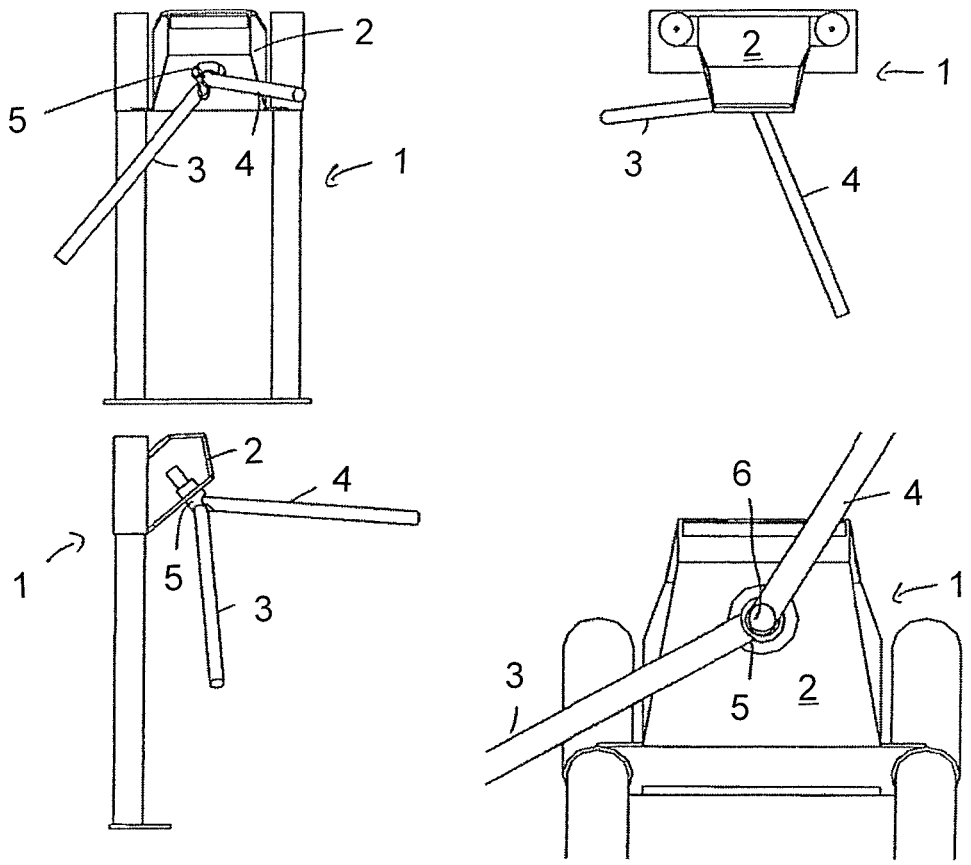
FIG. 2: shows a turnstile according to FIG. 1 in which after detection of a valid access authorization, only the second barrier arm is turned through 30° in the direction of passage.
Figure 3:
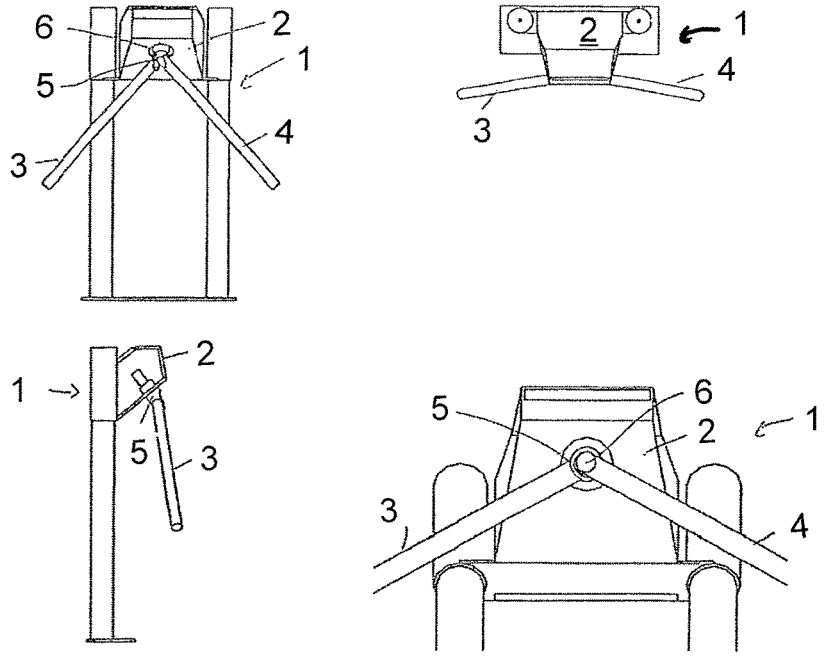
FIG. 3: shows a turnstile according to FIG. 1 in which after the turning of only the second barrier arm through 30° in the direction of passage shown in FIG. 2, only the second barrier arm is turned through a further 90° whereby the entire passage is released in order to grant passage to the person approaching the first barrier arm in the initial position.

When a person who is standing in front of the second barrier arm 4 blocking the passage and who is carrying a valid access authorization which is detected by a reading device not shown, the second barrier arm 4 is controlled in such a manner that it is turned through 30° in the passage direction, as illustrated by means of FIG. 2. As a result of a further turning through a further 90°, the entire passage is released in order to grant passage to the person as shown by means of FIG. 3. In the example shown, the first barrier arm 3 is not turned during the rotation of the second barrier arm 4. In the course of further embodiments, the first barrier arm can be turned through a small angle, for example, through 30° in order to begin to block the passage behind the person at this time.

Figure 4:
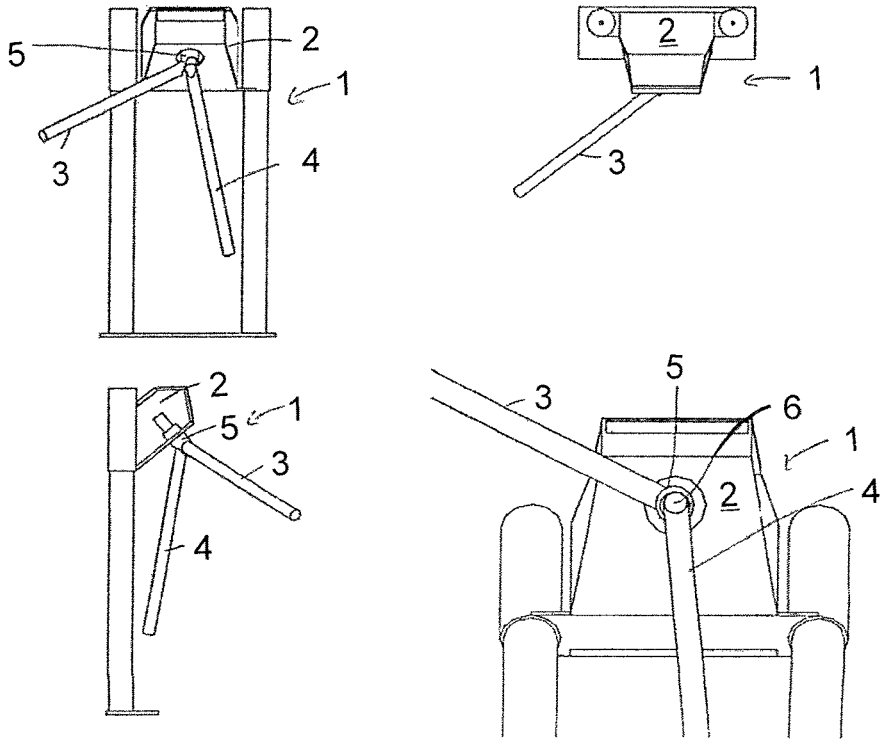
Figure 5:
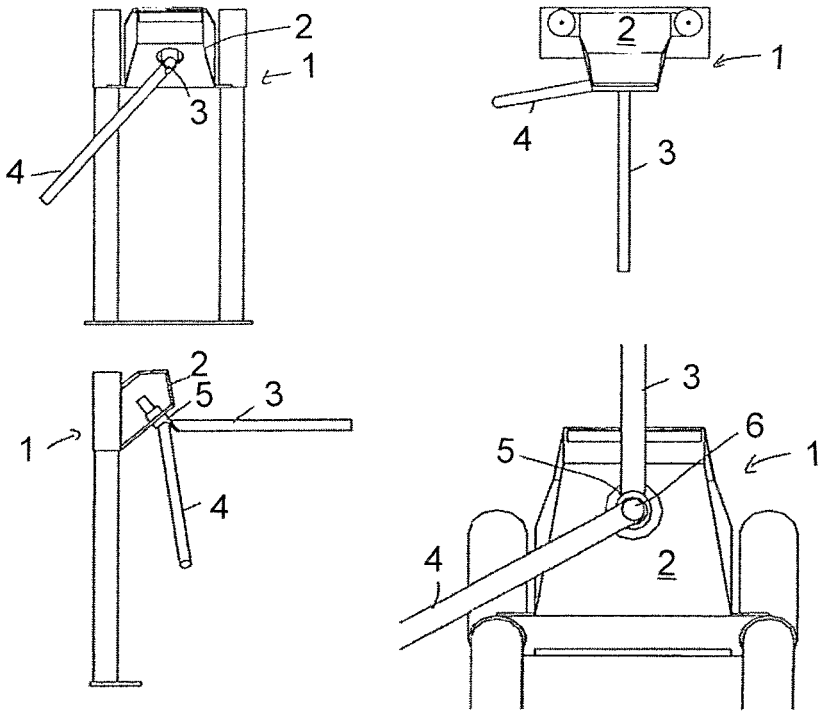
FIG. 5: shows a turnstile according to FIG. 1 in which the barrier arms according to the arrangement shown in FIG. 4 are turned independently of one another in such a manner that the initial position according to FIG. 1 is reached with the difference that the first barrier arm blocks the passage wherein the second barrier arm releases the entire passage.
Figure 6:
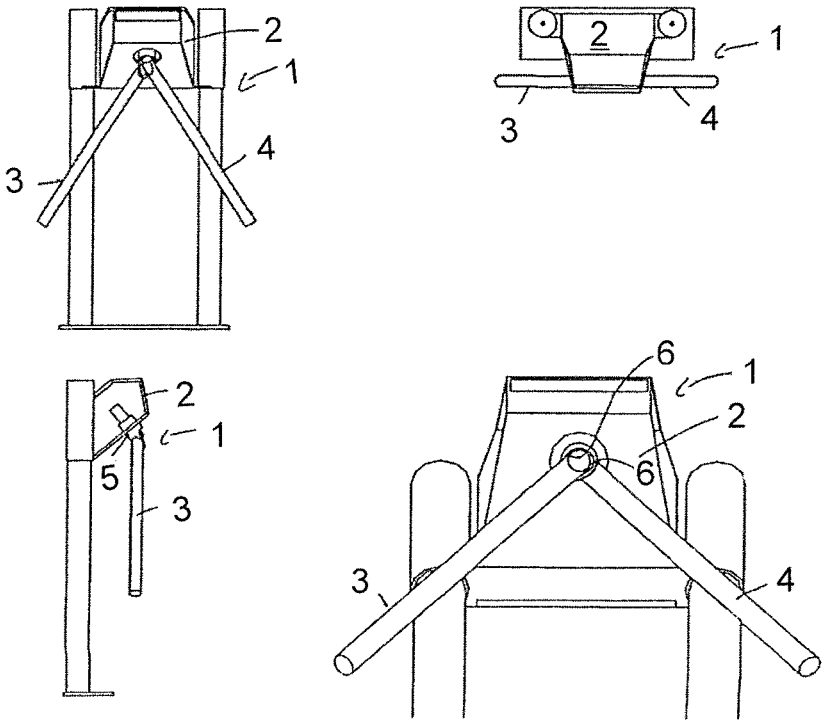
FIG. 6: shows a turnstile according to FIG. 1 to illustrate the position of the barrier arms in an emergency or when the turnstile is to be put out of operation permanently, wherein the barrier arms extend downwards in the plane of the passage at the smallest possible angle with respect to one another so that the passage is released.

Then the first and the second barrier arm 3, 4 are turned independently of one another, wherein at the end of these turning movements the second barrier arm 4 extends substantially perpendicular to the plane of the passage and the first barrier arm 3 begins to block the passage behind the person who has passed through; this situation is illustrated by means of FIG. 4. In the further course the barrier arms 3, 4 are turned independently of one another in such a manner that the initial position according to FIG. 1 is reached with the difference that the first barrier arm 3 blocks the passage wherein the second barrier arm 4 releases the entire passage.

In an emergency or when the turnstile 1 is to be put out of operation permanently, the barrier arms 3, 4 are controlled in such a manner that they extend downwards in the direction of the plane of the passage at the smallest possible angle with respect to one another so that the passage is released. In the example shown the smallest possible angle between the barrier arms is 120° due to the first shaft 5 designed as a hollow shaft since the recess of the hollow shaft 5 extends over an angular range of 240°.

In the example shown in FIGS. 7 to 12 the second barrier arm 4 connected in a torque-proof manner to the second shaft projects from the end of the first shaft 5 designed as a hollow shaft facing away from the housing 2 of the turnstile 1 so that an arbitrary relative movement of the two barrier arms 3, 4 with respect to one another can be achieved.

Figure 7:
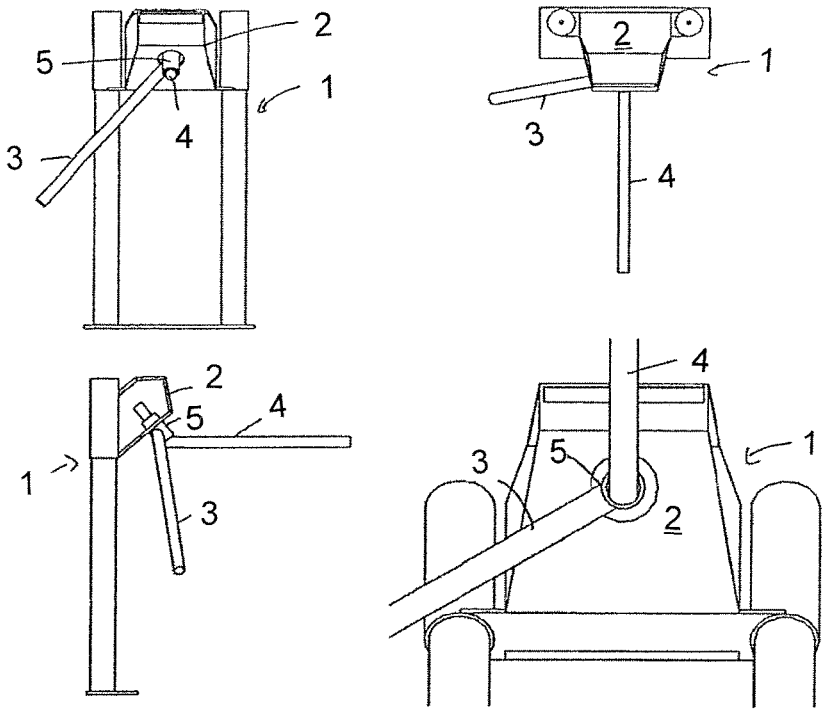
FIG. 7: snows a turnstile according to the invention in which the second barrier arm connected in a torque-proof manner to the second shaft projects from the end of the first shaft designed as a hollow shaft, facing away from the housing of the turnstile so that an arbitrary relative movement of the two barrier arms with respect to one another can be achieved in an initial position in which the second barrier arm blocks the passage, wherein the first barrier arm releases the entire passage with the result that a person can comfortably approach the second barrier arm.

In the initial position which is illustrated by means of FIG. 7, the passage is blocked by the second barrier arm 4 wherein the first barrier arm 3 projects slightly into the passage in order to make it difficult to climb underneath. According to the invention, in the initial position the barrier arm which does not block the passage, i.e. in the example shown in FIG. 7, the first barrier arm 3, can completely release the passage.

Figure 8:
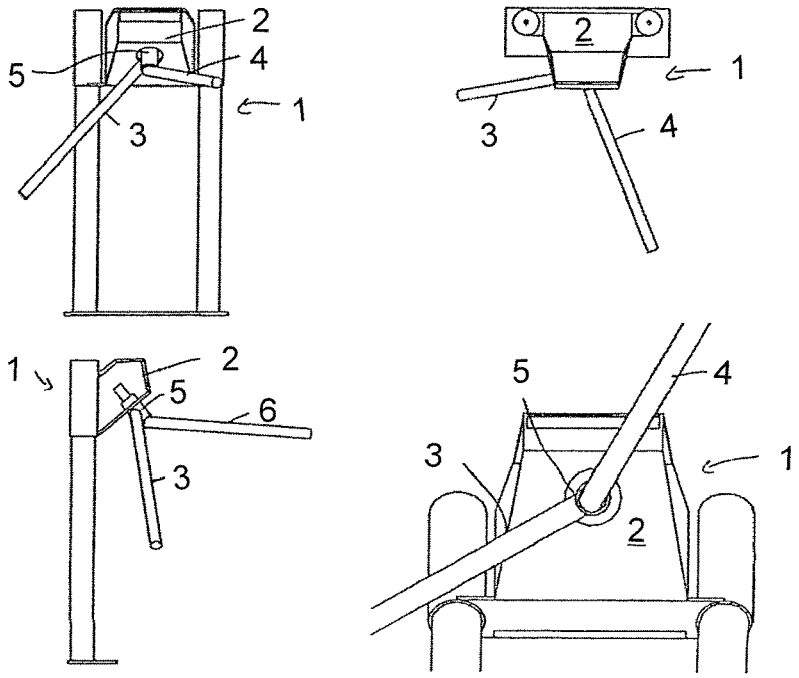
FIG. 8: shows a turnstile according to FIG. 7 in which after detection of a valid access authorization, only the second harrier arm is turned through 30° in the passage direction.
Figure 9:
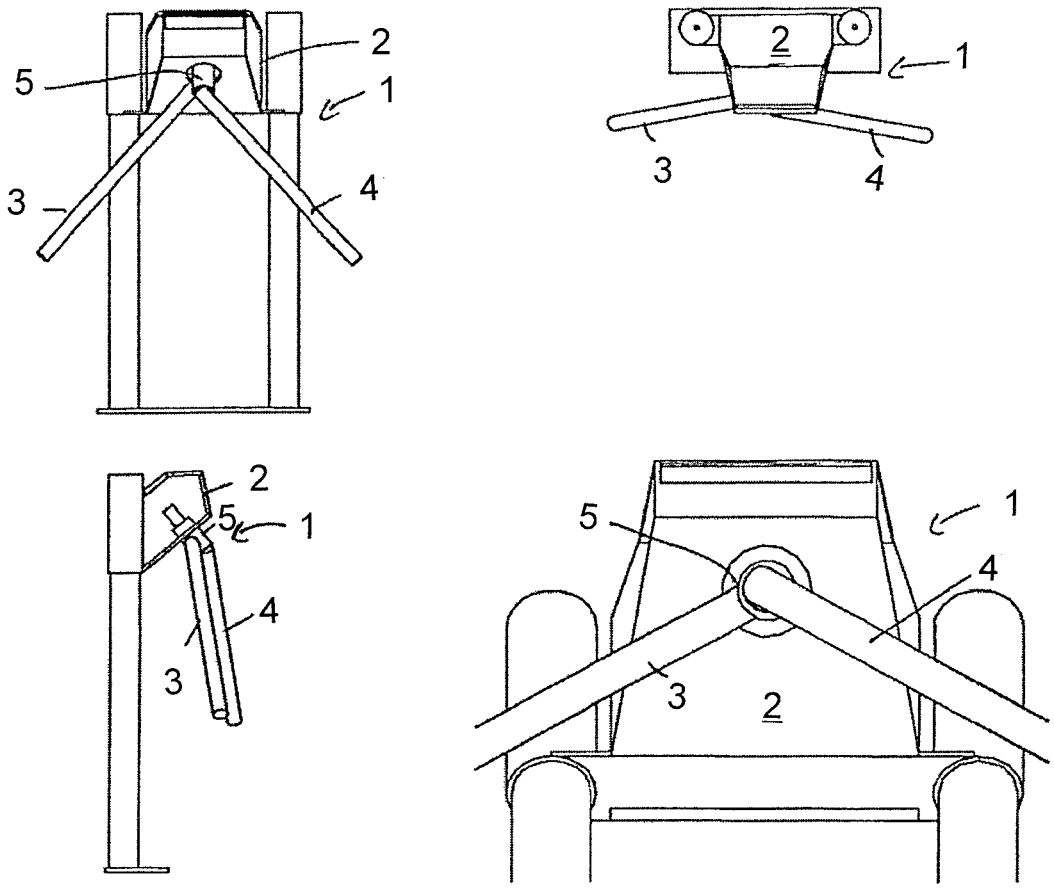
FIG. 9: shows a turnstile according to FIG. 7 in which after the turning of only the second barrier arm through 30° in the passage direction shown in FIG. 8, only the second barrier arm is turned through a further 90° with the result that the entire passage is released in order to grant passage to the person approaching the first barrier arm in the initial position.

When a person who is standing in front of the second barrier arm 4 blocking the passage and who is carrying a valid access authorization which is detected by a reading device not shown, in the example shown the second barrier arm 4 is controlled in such a manner that it is turned through 30° in the passage direction, as illustrated by means of FIG. 8. As a result of a further turning through a further 90°, the entire passage is released in order to grant passage to the person as shown by means of FIG. 9. In the example shown, the first barrier 3 arm is not turned during the rotation of the second barrier arm 4. In the course of further embodiments, the first barrier arm can be turned through a small angle, for example, through 30° in order to begin to block the passage behind the person at this time.

Figure 10:
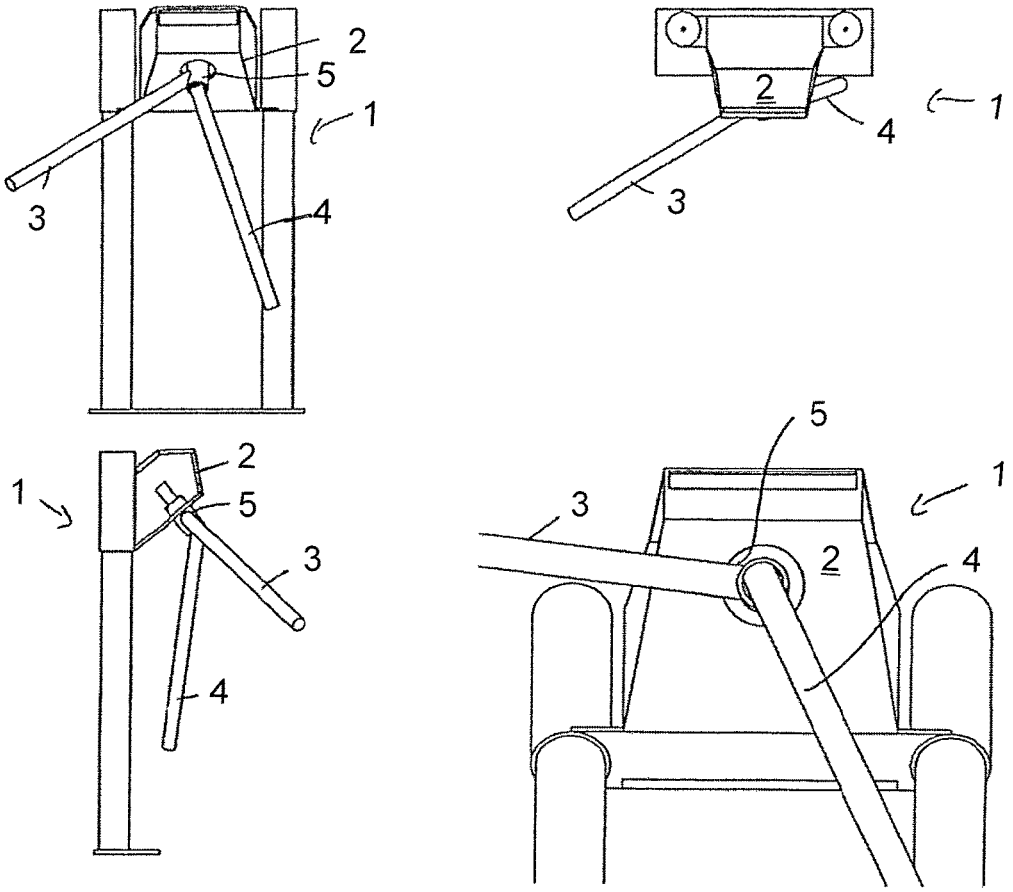
Figure 11:
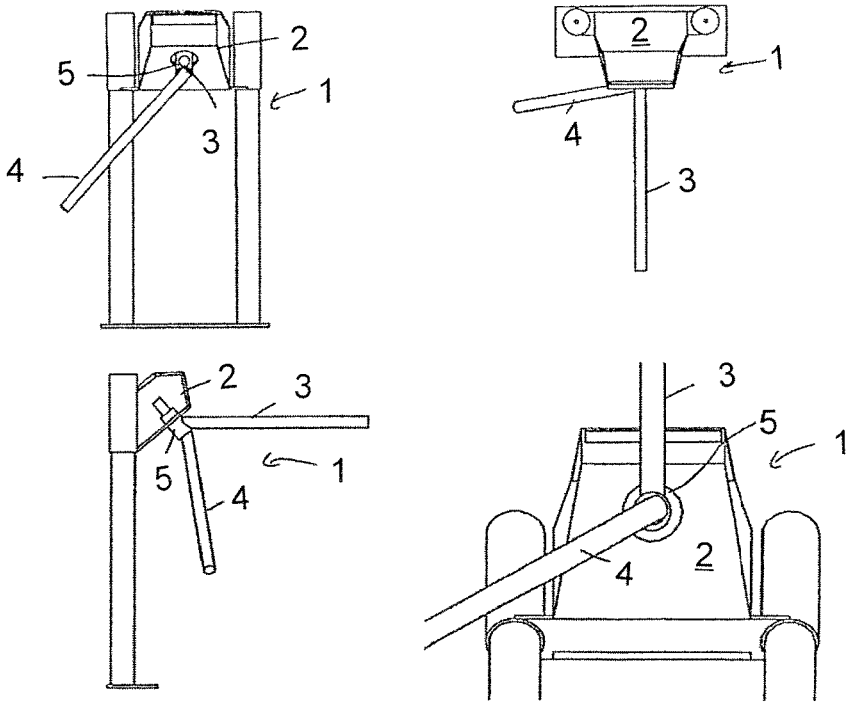
FIG. 11: shows a turnstile according to FIG. 7 in which the barrier arms according to the arrangement shown in FIG. 4 are turned independently of one another in such a manner that the initial position according to FIG. 1 is reached with the difference that the first barrier arm blocks the passage, wherein the second barrier arm releases the entire passage.
Figure 12:
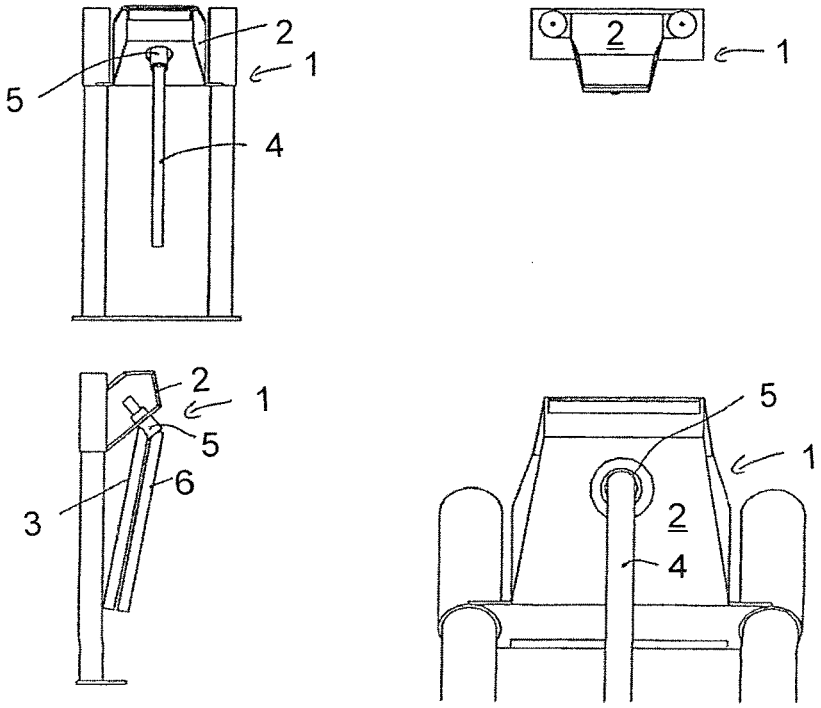
FIG. 12: shows a turnstile according to FIG. 7 to illustrate the position of the barrier arms in an emergency or when the turnstile is to be put out of operation permanently, wherein the barrier arms extend with their longitudinal axes substantially parallel to one another downwards in the direction of the plane of passage so that the passage is released.

Then the first and the second barrier arm 3, 4 are turned independently of one another, wherein at the end of these turning movements the second barrier arm 4 extends substantially perpendicular to the plane of the passage and the first barrier arm 3 begins to block the passage behind the person who has passed through; this situation is illustrated by means of FIG. 10. In the further course the barrier arms 3, 4 are turned independently of one another in such a manner that the initial position according to FIG. 7 is reached with the difference that the first barrier arm 3 blocks the passage wherein the second barrier arm 4 releases the entire passage.

In an emergency or when the turnstile 1 is to be put out of operation permanently, the barrier arms 3, 4 are controlled in such a manner that they extend downwards in the direction of the plane of the passage at the smallest possible angle with respect to one another so that the passage is released. In the example shown the smallest possible angle is 0° since an arbitrary relative movement of the two barrier arms 3, 4 with respect to one another can be achieved. The barrier arms 3, 4 extend downwards in the direction of the plane of the passage with their longitudinal axes substantially parallel to one another so that the passage is released.

A two-direction operation is possible with the turnstile according to the invention. The direction of passage can be reversed wherein in this case the movements of the barrier arms shown as an example take place in the opposite direction.

The invention claimed is:

1. A control device in a form of a turnstile (1) arranged along a passage for at least one of controlling access of persons past the control device and counting of persons passing the control device along the passage, the control device comprising:

a housing (2) in which at least one drive means is arranged, first and second barrier arms (3, 4) which are drivable by the at least one drive means, the first and the second barrier arms being drivable and controllable independently of one another and either at a same speed or a different speed, the first barrier arm (3) being arranged on a first shaft (5) and the second barrier arm (4) being arranged on a second shaft (6), the first and the second shafts (5, 6) being arranged coaxially and defining a central longitudinal axis, the first shaft (5) being hollow, and the second shaft (6) extending through the first shaft (5), the first and the second shafts (5, 6) being driven by the at least one drive means, the first barrier arm (3) being connected to the first shaft (5), such that the first barrier arm (3) is at a first predefined angle relative to the first shaft (5) and the first barrier arm (3) rotates in unison with the first shaft (5), and the second barrier arm (4) being connected to the second shaft (6), such that the second barrier arm (4) is at a second predefined angle relative to the second shaft (6) and the second barrier arm (4) rotates in unison with the second shaft (6), the first shaft (5) having a remote end facing away from the housing of the turnstile (1), the remote end of the first shaft (5) having a recess which is arranged diametrically opposite to the first barrier arm (3) connected to the first shaft (5), the second barrier arm (4) connected to the second shaft (6) projecting out through the recess in the remote end of the first shaft (5), the recess in the remote end of the first shaft (5) extends over a predefined angular range, and the first and the second barrier arms (3, 4) project axially from a same axial position, when viewed along the central longitudinal axis of the shafts (5, 6) which are arranged coaxially with respect to one another, at least one electric motor being the at least one drive means before which a transmission with two outputs is connected, and the two outputs respectively either being connected to the first and the second shafts (5, 6), or being connected detachably to the first and the second shafts by a controllable coupling, and when the controllable coupling is open, the first and the second shafts are rotatable against a predefined resistance which is selected in such a manner that the respective first and the second barrier arms remain fixed, if no external application of force is placed thereon, and the first and the second barrier arms being rotatable when a defined torque is placed thereon.

2. The control device in the form of the turnstile (1) according to claim 1, wherein the first and the second barrier arms (3, 4) are driven and controlled in such a manner to ensure separation and enable passage past the control device either when, a valid access authorization is detected, if the control device is controlling access of the persons past the control device, or the person is detected in the passage, if the control device is counting the persons passing the control device along the passage.

3. The control device in the form of the turnstile (1) according to claim 2, wherein the first and the second barrier arms (3, 4) are driven and controlled independently of one another in such a manner that, either when the valid access authorization is detected, if the control device is controlling access of the persons past the control device, or when the person is detected in the passage, if the control device is counting the persons passing the control device along the passage, from a starting condition, in which one of the first and the second the barrier arms is arranged in a blocking position in front of the person to block access and passage of the person past the control device in a direction along the passage, the one of the first and the second the barrier arms moves to an open position enabling passage of the person past the control device, and the other one of the first and the second barrier arms, which in the starting condition is in the open position moves to the blocking position in front of the subsequent person to block access and passage of the subsequent person past the control device in the direction along the passage, the first and the second barrier arms alternately moving between the open and the blocking positions.

4. The control device in the form of the turnstile (1) according to claim 1, wherein the recess extends over the angular range of between 200° and 300°.

5. The control device in the form of the turnstile (1) according to claim 1, wherein either in an emergency or if the turnstile (1) is to be permanently taken out of operation, both of the first and the second barrier arms (3, 4) are controlled in such a manner that the first and the second barrier arms (3, 4) extend, at a smallest possible angle with respect to one another, in a direction of a plane of the passage such that passage of the persons passing the control device along the passage is enabled.

6. The control device in the form of the turnstile (1) according to claim 1, wherein the control device comprises a battery which supplies the drive means with power in an event of a power failure.

7. A control device in a form of a turnstile being arranged along a passage for at least one of controlling passage of and counting of persons passing the control device along the passage, the control device comprising a housing in which first and second electric motors are arranged;

a first shaft being connected to and driven by the first electric motor and a second shaft being connected to and driven by the second electric motor, the first and the second shafts being independently controllable and drivable either at a same speed or at different speeds;

the first and the second shafts being coaxially aligned along a longitudinal axis, the first shaft being hollow and having a remote end that is opposite from an end that is proximate to the housing;

the second shaft extending through the first shaft and having a remote end that is opposite from an end that is proximate to the housing;

a first barrier arm being connected to the remote end of the first shaft such that the first barrier arm and the first shaft rotate in unison, and the first barrier arm extending at a first predefined angle relative to the first shaft;

a second barrier arm being connected to the remote end of the second shaft such that the second barrier arm and the second shaft rotate in unison, and the second barrier arm extending at a second predefined angle relative to the second shaft;

the remote end of the first shaft having a recess which is arranged diametrically opposite from the first barrier arm, the second barrier arm extending from the remote end of the second shaft through the recess in the remote end of the first shaft such that the first and the second barrier arms projecting axially from a same position along the longitudinal axis; and the recess in the remote end of the first shaft extending over a predefined angular range.

* * * * *